US005129459A

United States Patent [19]

Breese et al.

[11] Patent Number: 5,129,459

[45] Date of Patent: Jul. 14, 1992

[54] SUBSEA FLOWLINE SELECTOR

[75] Inventors: Peter Breese; Stanley Hosie, both of Houston, Tex.

[73] Assignee: ABB Vetco Gray Inc., Houston, Tex.

[21] Appl. No.: 740,360

[22] Filed: Aug. 5, 1991

[51] Int. Cl.[5] ..... E21B 34/04

[52] U.S. Cl. ..... 166/339; 137/625.46; 137/874; 137/876; 166/70; 166/331; 166/340; 166/368; 193/23; 406/182

[58] Field of Search ..... 166/70, 75.1, 341, 339, 166/366, 368, 330, 331, 340; 137/625.46, 874, 876; 193/23, 29; 406/182

[56] References Cited

U.S. PATENT DOCUMENTS

| | | | |
|---|---|---|---|
| 3,545,474 | 12/1970 | Brown | 166/70 X |
| 3,545,489 | 12/1970 | Brown | 137/876 |
| 3,674,123 | 7/1972 | Lewis et al. | 193/23 |
| 4,068,729 | 1/1978 | Peevey | 175/8 |
| 4,133,418 | 1/1979 | Van Bilderbeek | 193/23 |
| 4,223,700 | 9/1980 | Jones | 137/625.46 X |
| 4,260,022 | 4/1981 | Van Bilderbeek | 166/339 |
| 4,270,611 | 6/1981 | Arnandeau et al. | 166/366 X |
| 4,291,724 | 9/1981 | Miller | 137/555 |
| 4,770,247 | 9/1988 | Wilkins | 166/341 |
| 4,886,401 | 12/1989 | Andrews et al. | 406/182 |

FOREIGN PATENT DOCUMENTS

| | | | |
|---|---|---|---|
| 3319273 | 12/1983 | Fed. Rep. of Germany | 137/874 |
| 3900172 | 7/1990 | Fed. Rep. of Germany | 406/182 |
| 1258794 | 9/1986 | U.S.S.R. | 406/182 |

*Primary Examiner*—Hoang C. Dang
*Attorney, Agent, or Firm*—James E. Bradley

[57] ABSTRACT

A flowline selector device has a housing with a single passage at the upper end and two or more passages at the lower end. A tube connects to the upper end and has a lower end that is offset from the axis of the housing. Reciprocating the tube up and down and rotating it causes the tube to index between the various ports in the lower end of the housing. The lower end of the tube stabs into cylindrical bores in each port. A piston located at the upper end of the tube cooperates with an orientation sleeve to cause the indexing and reciprocating movement.

11 Claims, 4 Drawing Sheets

SUBSEA FLOWLINE SELECTOR

BACKGROUND OF THE INVENTION

1. Field of the Invention

This invention relates in general to subsea well equipment, and in particular to a device used with a running tool for running tubing hangers or Christmas trees which will connect a single passage extending down from the drilling or production vessel to either the annulus flowline or to the production flowline.

2. Description of the Prior Art

In one type of subsea well, a string of tubing will extend through the production casing and be supported at the subsea wellhead by a tubing hanger. Typically, there will be two bores in the tubing hanger, one of which communicates with the tubing, and the other which communicates with the annulus surrounding the tubing. Access to these bores needs to be available for flowing fluids, setting plugs and subsea valves on wireline, and other uses.

Typically, subsea well tubing hangers have been run by using a multiple string riser extending from the well to the vessel. A riser of this nature is expensive and time consuming to install. Alternately, an operator might run the rubing hanger using two strings of tubing simultaneously. This procedure is cumbersome.

U.S. Pat. No. 4,770,247, Robert L. Wilkins, Sep. 13, 1988, discloses a selector that will run a subsea tubing hanger or a Christmas tree on a single string of drill pipe or tubing. The assembly includes a selector that will connect the single upper passage to one of the lower ports. This selection is handled by rotating the string. While the device may be workable, rotating the string can be a disadvantage, particularly in deep water. Also, in that device, the tube does not seal the connected port from the disconnected port.

U.S. Pat. Nos. 4,133,418, Jan. 9, 1979, and 4,260,022, Apr. 7, 1981, Bernard H. Van Bilderbeek, disclose a selector that will connect an upper passage to one of a number of ports located on the lower end. In that tool, an indexing mechanism, located at the lower end, is actuated by hydraulic pressure rather than rotating a drill string. While workable, improvements are desired.

SUMMARY OF THE INVENTION

In this invention, a flowline selector device is provided that is hydraulically actuated. The device has a housing with a selector tube located within the housing. An actuating mechanism will reciprocate and rotate the tube. The lower end of the tube is offset from the upper end and will stab into one of the ports located at the bottom of the housing. A seal seals the lower end of the tube in the port.

A piston is located at the upper end of the tube. Hydraulic fluid passages will supply fluid to the piston to move the tube upward relative to the housing. A spring urges the tube downward to a lower position. An orienting sleeve located at the upper end of the tube will cause the tube to rotate during the upward and downward strokes to cause it to index to different ports.

DETAILED DESCRIPTION OF THE INVENTION

Figure 1A:
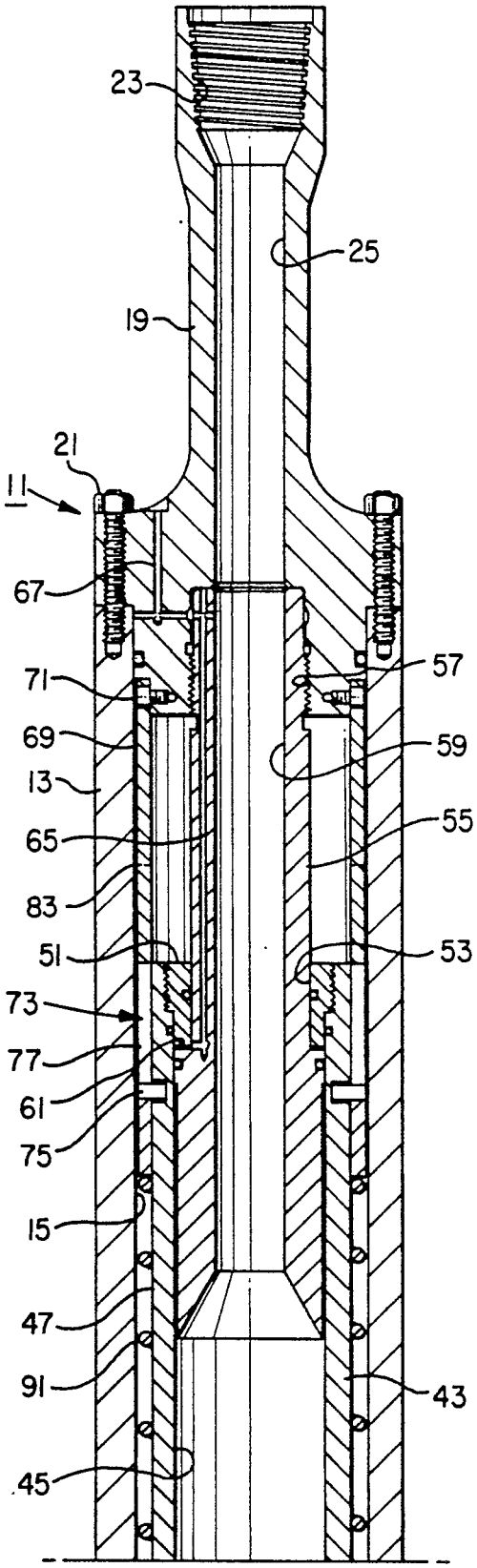
FIG. 1*a* and 1*b* comprise a vertical sectional view of a selector tool constructed in accordance with this invention, showing the selector tube in a lower position stabbed into the annulus port.

Referring to FIG. 1*a*, flowline selector 11 has a housing 13. Housing 13 is a tubular member with a cylindrical inner wall 15. An outlet port 17 (FIG. 1*b*) will communicate the interior of housing 13 to the exterior, unless plugged.

The upper end of housing 13 comprises an upper adapter 19. Upper adapter 19 secures by bolts 21 to housing 13. Threads 23 located on the upper end of upper adapter 19 secure the upper adapter 19 to either a string of drill pipe or a string of tubing. An axial passage 25 extends through the upper adapter 19, coinciding with the longitudinal axis of housing 13.

Figure 1B:
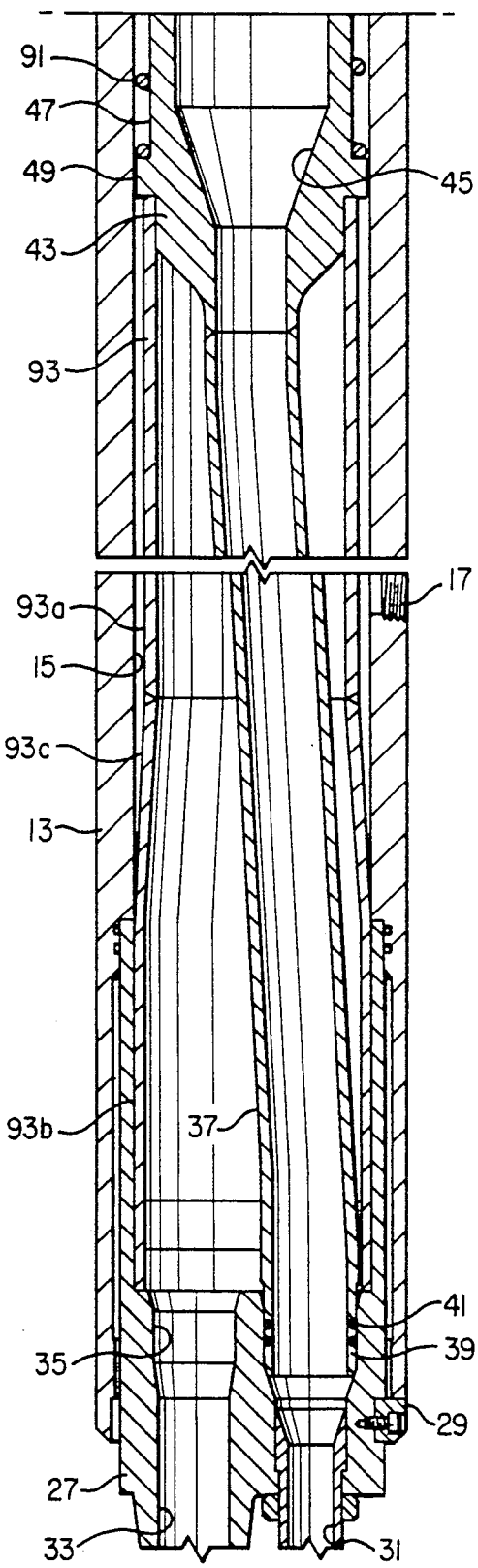

Referring to FIG. 1*b*, the lower end of housing 13 comprises a lower adapter 27. Lower adapter 27 secures to a running tool for running either a tubing hanger or a Christmas tree (not shown). An antirotation key 29 prevents the lower adapter 27 from unscrewing from threads on the lower end of housing 13. Lower adapter 27 has an annulus port 31 and a production port 33. Annulus port 31 communicates with the annulus surrounding the tubing (not shown) in the well. Production port 33 communicates with the interior of the tubing in the well.

Each port 31, 33 has a cylindrical receptacle or bore 35 at the lower end of housing 13. Each bore 35 has an axis that is parallel to but offset from the longitudinal axis of housing 13. The bores 35 are located 180 degrees from each other, on opposite sides of the longitudinal axis of housing 13. The selector 11 could also be utilized with multiple bore completions having more than two bores 35.

As shown in FIG. 1*b*, a selector tube 37 will communicate the adapter axial passage 25 (FIG. 1*a*) with either the annulus port 31 or the production port 33. The midsection of tube 37 is inclined and has a gradual curve, although not shown in the drawings. The upper end of tube 37 is located on the longitudinal axis of the housing 13. The lower end 39 of tube 37 will be offset from and parallel to the longitudinal axis of housing 13. A pair of resilient seals 41 serve as sealing means on lower end 39 for sealing the lower end 39 in one of the bores 35 of the ports 31, 33. Also, preferably, the lower end 39 forms a metal-to-metal seal with one of the bores 35 due to a tight fit.

The upper end of tube 37 comprises a tubular body 43 that is larger in diameter than the outer diameter of tube 37. Body 43 has an axial passage 45 that coincides with the longitudinal axis of housing 13. Body 43 has an outer diameter 47 that is less than the inner diameter of housing inner wall 15, resulting in an annular clearance. An external shoulder 49 located near the lower end of body 43 has an outer diameter that is substantially the same as the inner diameter of inner wall 15 of housing 13.

Referring to FIG. 1*b*, a piston 51 is secured to the upper end of the body 43 by threads. Piston 51 is a ring that locates in the axial passage 45 and moves in unison with the body 43. Piston 51 has an inner diameter 53.

A mandrel 55 secures to the adapter 19 and extends downward in housing 13. Mandrel 55 is a tubular member mounted to upper adapter 19 by means of threads 57. A passage 59 extends through mandrel 55 co-axial with the longitudinal axis of housing 13. Mandrel 55 has an upward facing external shoulder 61. Shoulder 61 engages the axial passage 45 of body 43 in sliding contact. The external portion of mandrel 55 above the shoulder 61 engages the inner diameter 53 of piston 51 in sliding contact. This results in a chamber 63 (FIG. 2*a*) that will exist between the lower end of piston 51 and the upper end of shoulder 61. The lower portion of mandrel 55 below the shoulder 61 engages the cylindrical wall of passage 45 in sliding contact.

Hydraulic passage means including a passage 65 will supply hydraulic fluid pressure to chamber 63. Hydraulic fluid passage 65 extends through the mandrel 55 and joins hydraulic fluid passages 67 in the upper adapter 19. Hydraulic fluid pressure will cause the piston 51 to move upward, bringing along with it the tube 37, as can be seen by comparing FIGS. 1*a* and 2*a*. As the tube 37 moves upward, the lower end 39 will pull out of one of the bores 35 entirely, as shown in FIG. 2*b*.

Figure 2A:
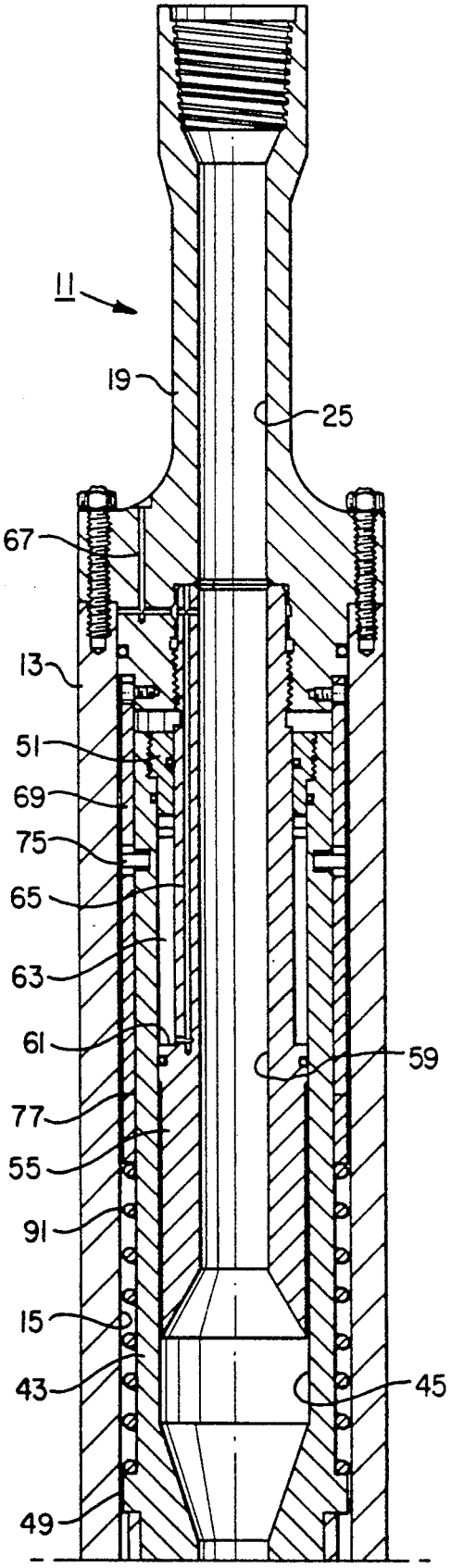
FIGS. 2*a* and 2*b* comprise a vertical sectional view of the selector tool of FIGS. 1*a* and 1*b*, but showing the selector tube in an upper position.
Figure 2B:
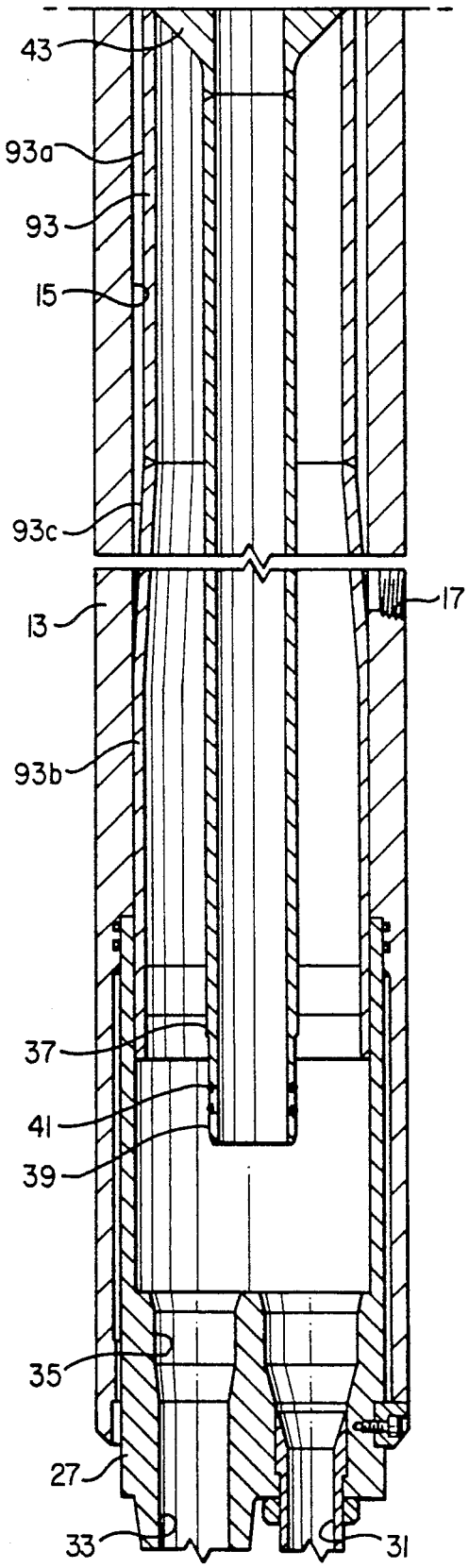
Figure 4:
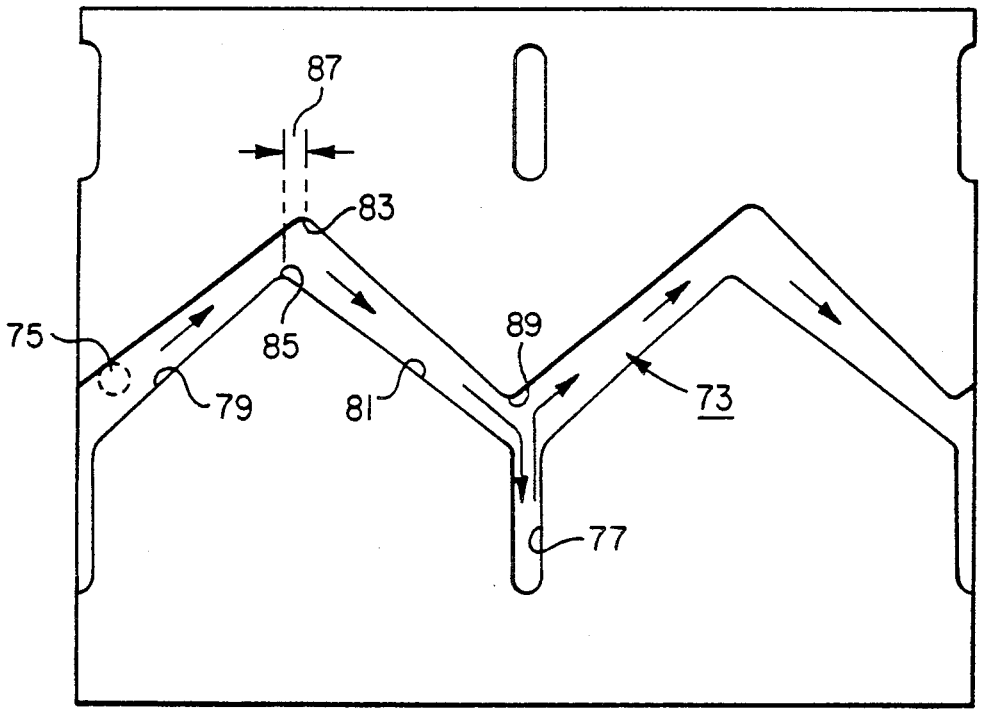
FIG. 4 is a schematic view of the orientation sleeve used with the selector tool of FIGS. 1*a* and 1*b*, shown flattened out to illustrate the cam slot.

Referring to FIG. 1*a* and 4, an orientation or cam sleeve 69 will cause the tube 37 to rotate when piston 51 moves the tube 37 to the upper position shown in FIG. 2*a*. Orientation sleeve 69 locates in contact with the inner wall 15 of housing 13. Fasteners 71 secure the upper end of orientation sleeve 69 to the upper adapter 19. A cam slot 73 formed in orientation sleeve 69 cooperates with two pins 75 to cause the rotation. Pins 75 are spaced 180 degrees from each other and extend radially outward from the body 43 of tube 37.

FIG. 4 illustrates the orientation sleeve 69 as if it had been cut and spread out flat to show the entire slot 73. As shown, slot 73 has two vertical sections 77, spaced 180 degrees apart from each other. Each vertical section 77 defines a lower position for tube 37, when lower end 39 of tube 37 will be stabbed into one of the bores 35 (FIG. 1*b*). Vertical section 77 assures that tube 37 pulls straight upward when being inserted into and out of the bore 35.

Each vertical section 77 leads to a raising section 79. The arrows indicate the relative movement of one of the pins 75 to the orientation sleeve 69. The raising section 79 is inclined relative to the longitudinal axis of housing 13. Raising section 79 confines pin 75 and requires it to rotate the tube 37 90 degrees as the tube 37 moves upward.

Each raising section 79 joins a lowering section 81, which in the preferred embodiment inclines at the same angle relative to the longitudinal axis as the raising section 79. The lowering section 81 causes the tube 37 to rotate another 90 degrees as the tube 37 is lowered. The lowering section 81 joins another of the vertical sections 77.

The upper inside corner 83 at the junction of the raising section 79 with the lowering section 81 is positioned so as to require the pin 75 to enter the lowering section 81 during upward movement of the tube 37, rather than possibly slide back down the raising section 79. This is handled by placing the inside corner 83 a slight rotational distance in a forward direction from the outside corner 85. This distance, indicated by the numeral 87, is shown in the drawing to be to the right, which indicates that the tube 37 moves in a counterclockwise direction in the embodiment shown. Pin 75 (FIG. 1*a*) when touching corner 83 and starting to move back downward, will contact the raising section 79 a slight distance in advance of the outside corner 85, insuring the proper indexing.

Similarly, the outside corner 89 is located a slight distance in a rearward rotational direction from the center of the vertical section 77. This assures that when the pin 75 moves upward in vertical section 77, it will contact raising section 79 to the right or forward of the outside corner 89. This assures that pin 75 will move to the right or counterclockwise.

Referring again to FIG. 1*a*, a coil spring 91 serves to push the tube 37 back downward once hydraulic fluid pressure at chamber 63 (FIG. 2*a*) is removed. Spring 91 encircles the body 43 of tube 37 and is located at the inner wall 15 of housing 13. The upper end of spring 91 bears against the lower end of orientation sleeve 69. The lower end of spring 91 bears against the upper side of shoulder 49 (FIG. 1*b*) of body 43. The hydraulic fluid pressure in chamber 63 will compress the coil spring 91 during the upward movement. Coil spring 91 supplies the force needed to assure complete insertion of the lower end 39 of tube 37 into one of the bores 35.

Referring to FIG. 1*b*, a guidance sleeve 93 moves with tube 37 to assure proper alignment. Guidance sleeve 93 has a cylindrical upper section 93*a* that secures to the tube upper body 43 for movement with the tube body 43. The guidance sleeve 93 has a cylindrical lower section 93*b* that engages the inner wall 15 in sliding contact, and also the inner wall of the lower adapter 27. The outer diameter of the upper section 93*a* is less than the outer diameter of the lower section 93*b*. This results in a clearance between the outer diameter of the upper section 93*a* and the inner wall 15 of housing 13. A conical section 93*c* joins the upper section 93*a* to the lower section 93*b*. Guidance sleeve 93 is perforated.

In operation, the flowline selector 11 will be used for an initial completion of a new well or for workover operations. Flowline selector 11 will be secured to a string of drill pipe or tubing. The lower adapter 27 of flowline selector 11 will be secured either to a tubing hanger, or to a Christmas tree. If running a tubing hanger, subsea safety valves (not shown) may be located in the tubing string below the tubing hanger. The flowline selector 11 has passages (not shown) through the wall of housing 13 for supplying hydraulic fluid pressure to open the subsea valves.

After setting the tubing hanger, and before running the Christmas tree, wireline plugs may be lowered through the conduit string for closing the production bore and annulus bore cf the tubing hanger prior to running the Christmas tree. If the flowline selector 11 is in the position shown in FIG. 1*b*, the plug and wireline tool (not shown) will pass through the axial passage 25, axial passage 59, tube 37 and into the production port 33. Then, the wireline tool may be retrieved.

The operator would supply hydraulic fluid pressure from the drilling vessel through a line (not shown) to the passages 67 and 65. The hydraulic fluid pressure causes the piston 51 to move upward, bringing along with it the tube 37. Piston 51 will move to the upper position shown in FIG. 2*a*. The lower end 39 of tube 37 will move above the bore 35 of the port 33. Referring to FIG. 4, the pin 75 will move up the vertical section and along the raising section 79, causing 90 degree rotation of the tube 37.

Figure 3A:
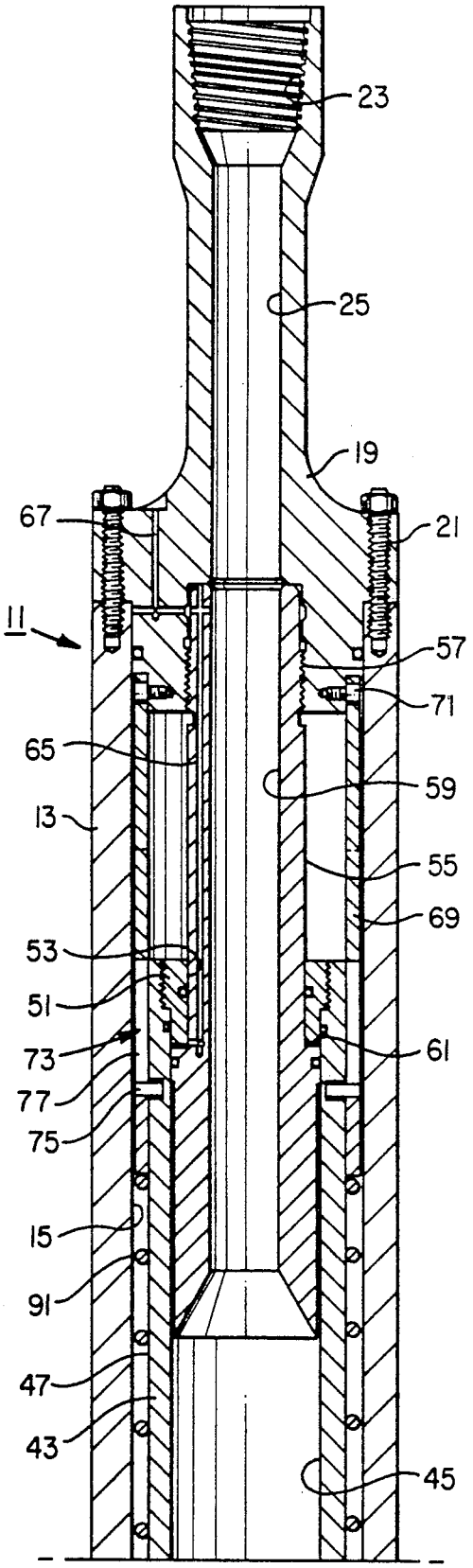
FIGS. 3*a* and 3*b* comprise a vertical sectional view of the selector tool of FIGS. 1*a* and 1*b*, but showing the selector tube stabbed into the production port.
Figure 3B:
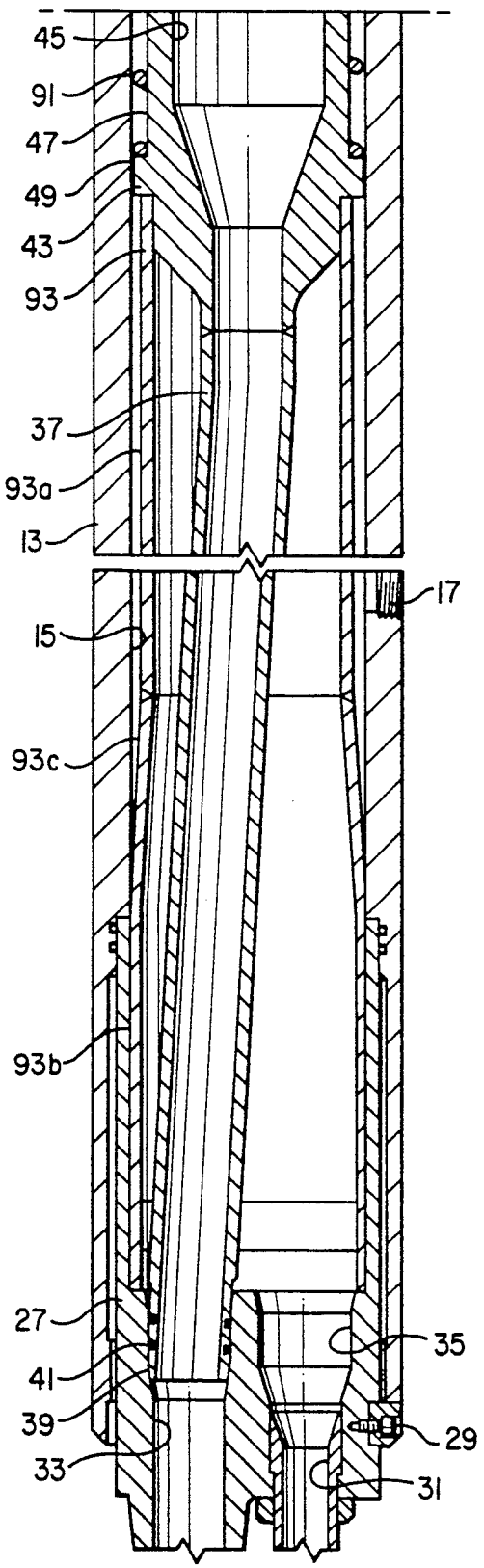

The operator will release hydraulic pressure after a period of time that is sufficient to assure that pin 75 is in the inside corner 83 before releasing. Once the operator releases the fluid pressure, the pin 75 will travel down the lowering section 81 and enter the next vertical section 77. This causes another rotation of 90 degrees. As shown in FIG. 3*b*, the lower end 39 of tube 37 will now enter the bore 35 of the annulus port 31. The spring 91 causes the downward movement. The operator may then lower a wireline tool through the conduit, passages 25, 59 and tube 37 to set a plug in the annulus port 31.

The operator may then retrieve the running tool and along with it the flowline selector 11. When running the Christmas tree, he would again utilize the flowline selector 11. This time, the operator would utilize the flowline selector 11 to retrieve the plugs. Various operations may be performed on the subsea well utilizing the flowline selector. For example, while in the position shown in FIGS. 2*a* and 2*b*, and while running the Christmas tree, the operator may wish to purge the string of conduit of production fluids. Production fluids may be in the conduit leading to the drilling vessel because of testing. If so, a hose may be connected to the outlet 17. The operator would circulate fluid down the string of conduit through the passages 25, 59 and tube 37 to flow back up the interior of housing 13 and out the side outlet 17. The perforations of the guidance sleeve 93 allow fluid to flow through the guidance sleeve 93 and out the side outlet 17.

The invention has significant advantages. The flowline selector operates hydraulically, not by rotation. The flowline selector has an effective seal between the selector tube and the ports, as the tube physically enters the bore of each port and seals to the cylindrical wall.

While the invention has been shown in only one of its forms, it should be apparent to those skilled in the art that it is not so limited, but is susceptible to various changes without departing from the scope of the invention.

We claim:

1. A flowline selector device, comprising in combination:

a housing having a longitudinal axis, an upper end adapted to be connected to a string of conduit, a lower end adapted to be connected to a subsea well assembly, an axial passage located at the upper end, and a plurality of ports located at the lower end and angularly spaced from each other, each of the ports having a cylindrical bore;

a tube having an upper end in fluid communication with the passage and a lower end offset from the upper end of the tube and the longitudinal axis of the housing, the lower end of the tube having a cylindrical sidewall for sliding and sealing engagement with the bore of one of the ports;

a piston mounted to the upper end of the tube for axial movement therewith;

hydraulic fluid passage means for supplying hydraulic fluid pressure to the piston to cause the piston to move the tube upward to an upper position to remove the lower end of the tube from the bore of one of the ports;

means mounted to the tube for moving the tube downward from the upper position to a lower position; and orientation means located at the upper end of the tube for rotating the tube relative to the housing when the tube moves from the lower position to the upper position and back to the lower position, for indexing the lower end of the tube over to enter the bore of another of the ports.

2. The flowline selector according to claim 1 wherein the upper end of the tube is a body having an axial passage, wherein the piston is an annular member mounted in the axial passage of the body, and wherein the flowline selector further comprises:

a tubular mandrel secured to the housing and extending downward into the axial passage of the body of the tube, the mandrel having an external shoulder located below the piston which is slidingly engaged by the axial passage of the body of the tube; and wherein the hydraulic fluid passage means comprises:

a passage extending through the mandrel above the shoulder for supplying hydraulic fluid pressure between the shoulder and the piston.

3. The flowline selector according to claim 1 wherein the means mounted to the tube for moving the tube downward from the upper position to a lower position comprises a coil spring encircling the upper end of the tube.

4. The flowline selector according to claim 1 wherein the upper end of the tube is a body having an external shoulder that sliding engages an inner wall of the housing while the tube moves between the upper and lower positions, and wherein the flowline selector further comprises:

a guidance sleeve mounted to the body of the tube and extending downward with the tube located therein, the guidance sleeve having a lower end which slidingly engages the inner wall of the housing while the tube moves between the upper and lower positions.

5. A flowline selector device, comprising in combination:

a housing having an inner cylindrical wall, a longitudinal axis, an upper end having an adapter for connection to a string of conduit, a lower end adapted to be connected to a subsea well assembly, an axial passage extending through the adapter, and a plurality of ports located at the lower end and angularly spaced from each other, each of the ports having a cylindrical bore;

a tubular mandrel secured to the adapter of the housing and extending downward in the housing, the mandrel having an external shoulder;

a tube having a tubular body at its upper end with an axial passage which slidingly receives the mandrel, the tube having a lower end offset from the body of the tube and the longitudinal axis of the housing, the lower end of the tube having a cylindrical sidewall for sliding engagement with the bore of one of the ports;

seal means on the sidewall at the lower end of the tube for sealing the tube within the bore of one of the ports;

an annular piston secured in the axial passage of the body of the tube, the piston having an inner diameter which slidingly engages the mandrel above the external shoulder of the mandrel;

hydraulic fluid passage means extending through the mandrel for supplying hydraulic fluid pressure between the piston and the external shoulder of the mandrel, to cause the piston to move the tube upward to an upper position to remove the lower end of the tube from the bore of one of the ports;

spring means including a coil spring mounted to the exterior of the body of the tube for urging the tube downward to a lower position; and orientation means located at the upper end of the tube for rotating the tube relative to the housing when the tube moves from the lower position to the upper position and back to the lower position, for indexing the lower end of the tube over to enter the bore of another of the ports.

6. The flowline selector according to claim 5 wherein the orientation means comprises:

an orientation sleeve mounted to the adapter and located between the inner wall of the housing and the body of the tube;

a slot extending around the sleeve having raising and lowering sections; and a pin mounted to the body of the tube for engaging the slot, the pin moving upward in a raising section when hydraulic fluid pressure is applied to the piston, the pin moving downward in a lowering section when hydraulic fluid pressure to the piston is removed and the spring moves the tube back to the lower position, at least one of the sections being inclined relative to the longitudinal axis of the housing to cause rotation of the tube as the pin moves along said one section.

7. The flowline selector according to claim 5, further comprising:

a guidance sleeve mounted to the body of the tube and extending downward with the tube located therein, the guidance sleeve having a lower end which slidingly engages the inner wall of the housing while the tube moves between the upper and lower positions.

8. The flowline selector according to claim 5, further comprising:

a guidance sleeve mounted to the body of the tube and extending downward with the tube located therein, the guidance sleeve having a lower end which slidingly engages the inner wall of the housing while the tube moves between the upper and lower positions, the lower end of the guidance sleeve being of larger outer diameter than the upper end of the guidance sleeve.

9. A flowline selector device, comprising in combination:

a housing having an inner cylindrical wall, a longitudinal axis, an upper end having an adapter for connection to a string of conduit, a lower end adapted to be connected to a subsea well assembly, an axial passage extending through the adapter, and a plurality of ports located at the lower end and angularly spaced from each other, each of the ports having a cylindrical bore;

a tubular mandrel secured to the adapter of the housing and extending downward in the housing, the mandrel having an external shoulder;

a tube having a tubular upper body at its upper end with an axial passage which slidingly receives the mandrel, the tube having a lower end offset from the upper body of the tube and the longitudinal axis of the housing, the lower end of the tube having a cylindrical sidewall for sliding engagement with the bore of one of the ports;

seal means on the sidewall at the lower end of the tube for sealing the tube within the bore of one of the ports;

an annular piston secured in the axial passage of the upper body of the tube, the piston having an inner diameter which slidingly engages the mandrel above the external shoulder of the mandrel;

hydraulic fluid passage means extending through the mandrel for supplying hydraulic fluid pressure between the piston and the external shoulder of the mandrel, to cause the piston to move the tube upward to an upper position to remove the lower end of the tube from the bore of one of the ports;

spring means including a coil spring mounted to the exterior of the upper body of the tube for urging the tube downward to a lower position;

an orientation sleeve mounted to the adapter and located between the inner wall of the housing and the body of the tube;

a slot extending around the sleeve having raising and lowering sections, each of which is inclined relative to the longitudinal axis of the housing;

a pin mounted to the upper body of the tube for engaging the slot, the pin moving upward in a raising section when hydraulic fluid pressure is applied to the piston, thereby causing the tube to rotate, the pin moving downward in a lowering section when hydraulic fluid pressure to the piston is removed and the spring moves the tube back to the lower position, thereby causing further rotation of the tube;

an external shoulder formed on the upper body of the tube in sliding engagement with the inner wall of the housing;

a guidance sleeve mounted to the upper body of the tube below the external shoulder of the upper body of the tube and extending downward with the tube located therein, the guidance sleeve having a lower end which slidingly engages the inner wall of the housing while the tube moves between the upper and lower positions; and the coil spring being compressed between the external shoulder on the upper body of the tube and the orientation sleeve.

10. The flowline selector according to claim 9 wherein the lower end of the guidance sleeve has a larger outer diameter than the upper end of the guidance sleeve.

11. The flowline selector according to claim 9 wherein guidance sleeve extends substantially to the ports when the tube is in the lower position, with the lower end of the tube protruding below the guidance sleeve into the bore of one of the ports.

* * * * *

UNITED STATES PATENT AND TRADEMARK OFFICE

CERTIFICATE OF CORRECTION

PATENT NO. : 5,129,459

DATED : July 14, 1992

INVENTOR(S) : Peter Breese, Stenley Hosie

It is certified that error appears in the above-identified patent and that said Letters Patent is hereby corrected as shown below:

Column 1, line 27, "rubing" should be --tubing--;

Column 4, line 53, "cf" should be --of--.

Signed and Sealed this

Fifth Day of October, 1993

Bruce Lehman

*Attest:*

BRUCE LEHMAN

*Attesting Officer*

*Commissioner of Patents and Trademarks*